United States Patent [19]

Weiler

[11] 4,019,281

[45] Apr. 26, 1977

[54] QUICK RELEASE WINDOW GUARD

[76] Inventor: Ray C. Weiler, 17386 Vine St., Fontana, Calif. 92335

[22] Filed: Mar. 1, 1976

[21] Appl. No.: 662,377

[52] U.S. Cl. ..... 49/56; 49/67; 49/141; 292/42; 292/162

[51] Int. Cl.[2] ..... F06B 3/68

[58] Field of Search ..... 49/50, 52, 56, 61, 63, 49/64, 67, 141; 292/32, 33, 42, 92, 93, 137, 157, 162, DIG. 12, DIG. 25

[56] References Cited

UNITED STATES PATENTS

| | | | |
|---|---|---|---|
| 786,668 | 4/1905 | Nussbeck | 292/93 |
| 810,923 | 1/1906 | Dobelman | 49/56 |
| 2,389,315 | 11/1945 | Kerr | 49/141 |
| 2,668,729 | 2/1954 | Watters | 49/50 |
| 2,917,770 | 12/1959 | Etnyre | 292/DIG. 25 |
| 3,455,313 | 7/1969 | King | 135/45 A |
| 3,921,334 | 11/1975 | Black, Sr. | 49/141 |

*Primary Examiner*—Peter M. Caun

*Attorney, Agent, or Firm*—Dana E. Keech

[57] ABSTRACT

An external steel grating has seven vertical bars welded at their ends to upper and lower horizontal hollow cross bars, end portions of which cross bars are bent rearwardly and secured to a building so that the grating overlies a window opening and protects it against illegal entry.

One end of the grating has a loosely hinged connection with the building and the cross bars are jointed near the opposite end of the grating and locked in assembled relation by a hidden bolt in one of the cross bars. A cable from said bolt extends through the last mentioned cross bar to the interior of said building, which cable, when pulled, withdraws the bolt from its locking position and frees the joints for separation by gravity allowing the major hinged portion of the grating to swing freely outwardly and affording a ready escape from the building through said window.

8 Claims, 11 Drawing Figures

FIG. 5.
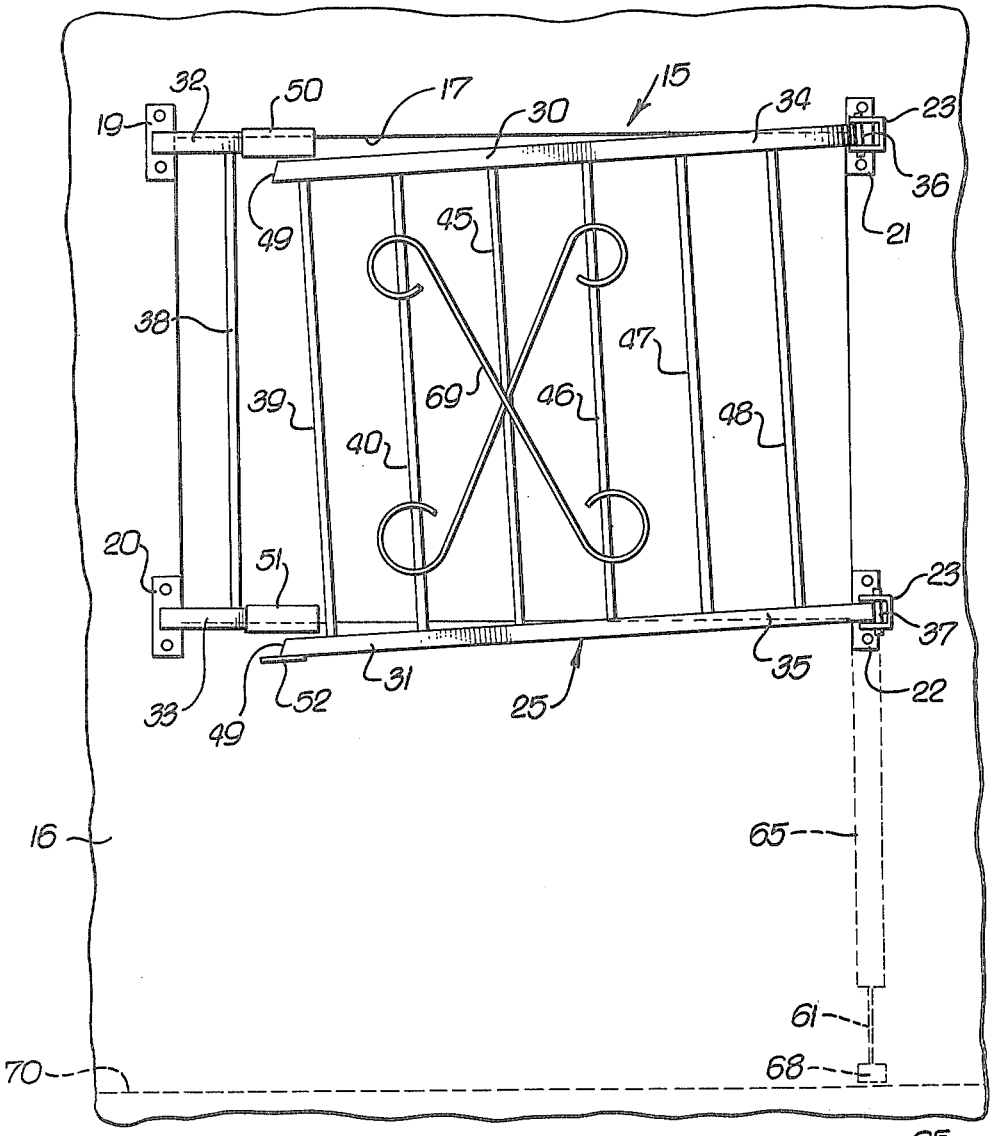
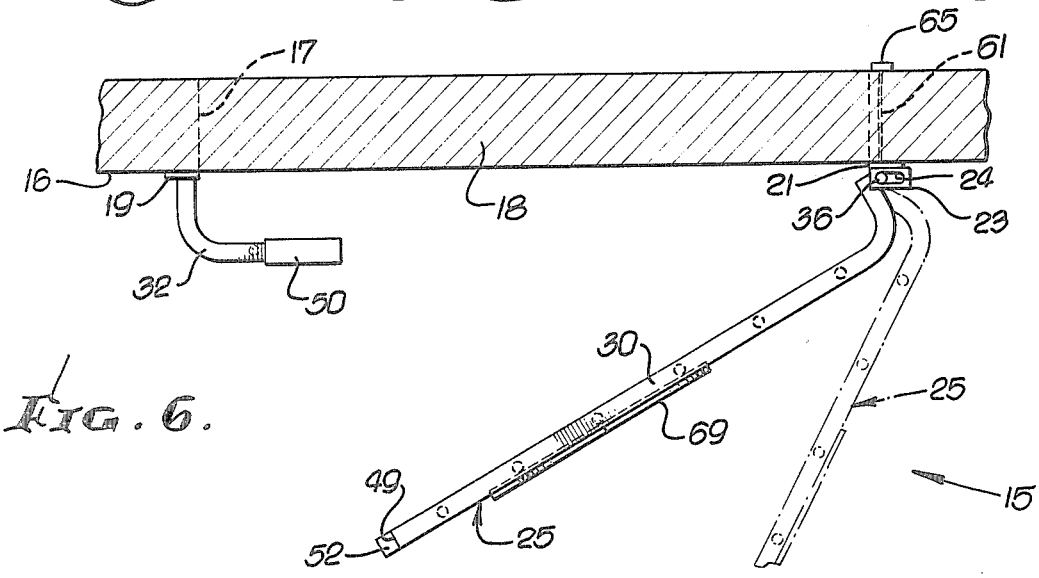
FIG. 6.

QUICK RELEASE WINDOW GUARD

SUMMARY OF THE INVENTION

The mounting of gratings on buildings which overlie the windows thereof to protect against illegal entry through a window is an ancient practice which is currently being resumed as a defense against the rising wave of crime. Attention has been drawn to the hazards thus incurred in case of fire by several instances where the presence of such gratings prevented dwellers escaping from a burning building thus resulting in their death. Warnings have been issued by fire departments against the use of window gratings for protection against burglary unless having a means for readily displacing these in the event of fire.

Inasmuch as the need to have windows protected against illegal entry is today very urgent, it is a primary object of the present invention to provide a window grating effective for this purpose yet having means operable only from inside the building equipped therewith to quickly displace the grating and allow escape through said window in the event of fire.

Another object of the invention is to provide such a window protecting grating which may be readily restored to its capacity for blocking illegal entry through the window covered thereby.

BRIEF DESCRIPTION OF THE DRAWINGS

FIG. 5 is a view similar to FIG. 1 showing the grating unlocked.

FIG. 6 is a view similar to FIG. 3 showing the grating unlocked.

DETAILED DESCRIPTION OF THE PREFERRED EMBODIMENT

Figures 1, 2, 3, 4:
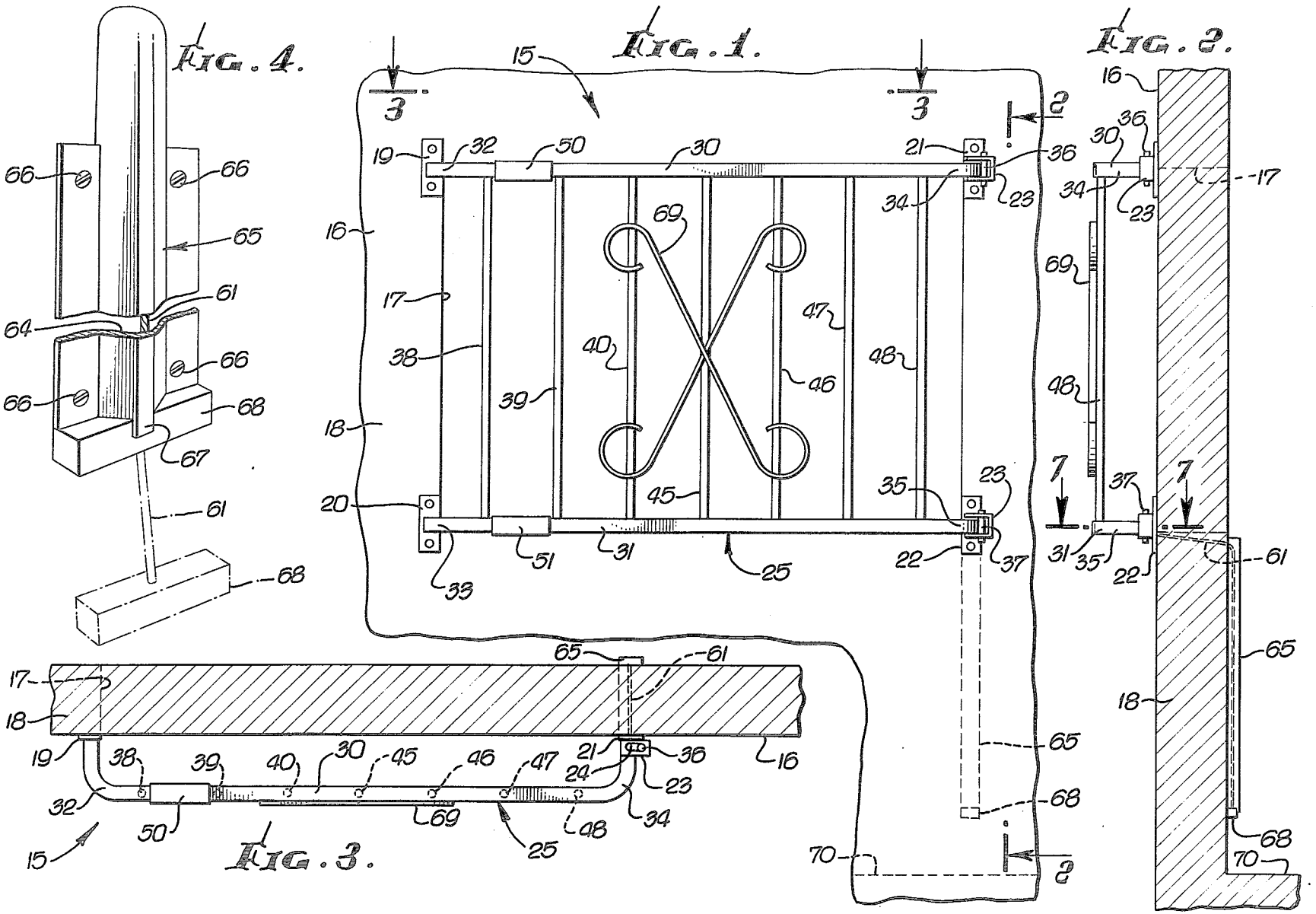
FIG. 1 is a front elevational view of the invention mounted on a building in covering relation with a window and with the grating in closed or fully assembled condition so as to be effective in preventing illegal entry through said window.
FIG. 2 is a vertical sectional view taken on the line 2—2 of FIG. 1.
FIG. 3 is a horizontal sectional view taken on the line 3—3 of FIG. 1.
FIG. 4 is a diagrammatic fragmentary perspective view of a housing for the lock opening cable of the invention and the handle on the extremity of said cable showing this in full lines when the grating of the invention is locked in defensive condition covering the window and in a broken line position as when the cable is actuated by depressing the handle to unlock the grating and render this free to swing outwardly permitting the escape of individuals through the window in the event of fire.

The quick release window guard 15 of the invention is adapted to be mounted on a building 16 in protective relation with a window opening 17 which is formed in a wall 18 of the building. While under normal circumstances the opening 17 would be provided with a glassed window, this is not shown in the drawing for purposes of simplification of the disclosure. The preferred embodiment of the invention 15 includes four wall bracket plates 19, 20, 21 and 22, the first two of which are on the left side of window opening 17 and the latter two of which are on the right side of said opening. The plates 19 and 20 are plain rectangular flat plates and the plates 21 and 22 are similar plates but have welded thereto U-shaped hinge boxes 23, upper and lower walls of which are provided with slots 24. The guard 15 also includes a grating 25 including upper and lower hollow square section tubular cross bars 30 and 31, the left end portions 32 and 33 of which are bent rearwardly and welded respectively to wall bracket plates 19 and 20. The right hand end portions 34 and 35 of cross bars 30 and 31 respectively are bent rearwardly to extend between the upper and lower walls of hinge boxes 23 and have welded thereto vertical pins 36 and 37 which extend through slots 24 of boxes 23 so as to allow both pivotal swinging and lateral slippage of the right hand portion of the grating 25 as will be made clear hereafter.

Figure 9:
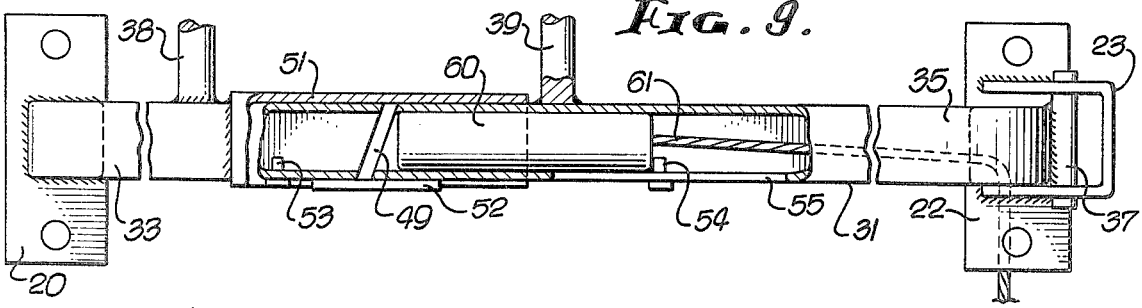
FIG. 9 is a view similar to FIG. 8 showing the locking bolt of the invention withdrawn so as to unlock the grating thereby allowing a substantial right hand portion of the grating to gravitate into open position (this view being taken prior to said portion responding to gravity after being unlocked).
Figure 10:
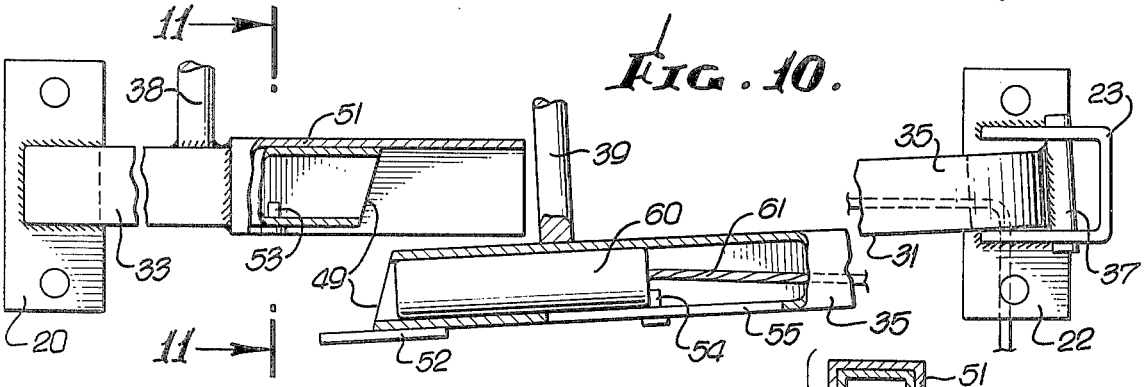
FIG. 10 is a view similar to FIG. 9 showing the effect of gravity on said grating resulting from the withdrawal of the locking bolt as shown in FIG. 9.
Figure 11:
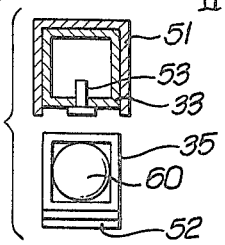
FIG. 11 is a vertical cross sectional detail taken on the line 11—11 of FIG. 10.

The upper cross bar 30 and lower cross bar 31 are rigidly joined together by seven vertical half-inch steel bars 38, 39, 40, 45, 46, 47, and 48. At a point 49 (see FIGS. 9 and 10) located midway between bars 38 and 39, both upper and lower cross bars 30 and 31 are divided by an oblique cut which completely separates the left end portions 32 and 33 of said cross bars from the right end portions 34 and 35 thereof. A pair of U-shaped hoods 50 and 51 are welded on left end cross bar portions 32 and 33 so as to overlie equally the left cross bar end portions 32 and 33 and the right cross bar end portions 34 and 35 when the latter are shifted from the positions in which they are shown in FIG. 10 upwardly into alignment with said cross bar left end portions, as shown in FIG. 9. Left end portion 33 is provided with a stop lug 53. The right end portion 35 of cross bar 31 has a stop lug 54 and also has a slot 55, the purposes of which will be made clear hereinafter.

Fitting slideably in the lower cross bar 31 so as to operate therein between the limits fixed by stop lugs 53 and 54 is a cylindrical bolt 60 which is axially bored to receive therein one end of a wire cable 61 which is secured to said bolt by set screws 62. The cable 61 is concealed within the lower cross bar 31 and is also threaded through a hole 63 provided in wall 18 from which said cable enters the upper end of the cavity 64 provided in the cable housing 65 fixed to the inner surface of the wall 18 as shown in FIGS. 2 and 4. The cable housing is thus secured by screws 66 to said wall and terminates at the lower end in a lug 67 which snugly overlies and holds in place a handle 68 which is secured to the inside terminal end of the cable 61. When bolt 60 is located as shown in FIGS. 7 and 8, handle 68 is positioned as shown in full lines in FIG. 4.

OPERATION

Figure 7:
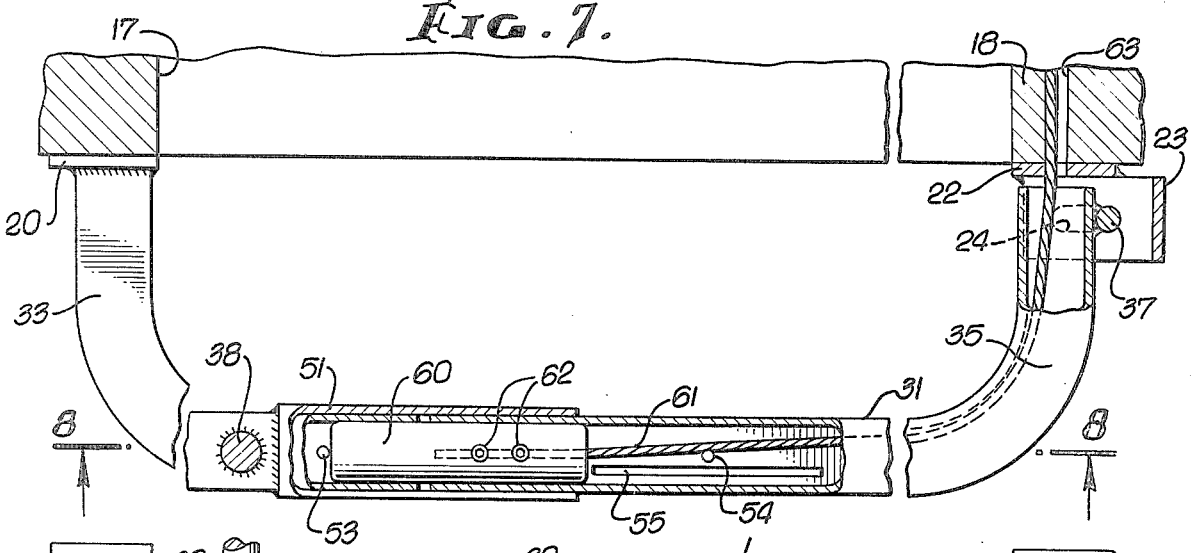
FIG. 7 is an enlarged fragmentary horizontal sectional view taken on the line 7—7 of FIG. 2.
Figure 8:
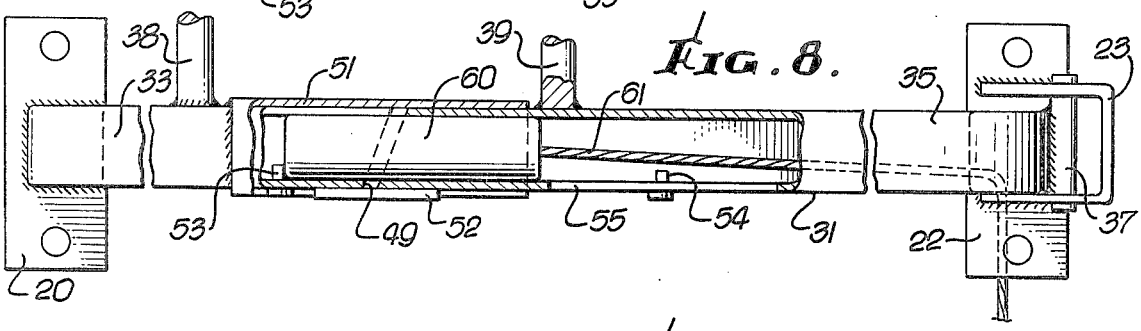
FIG. 8 is a fragmentary vertical sectional view taken on the line 8—8 of FIG. 7, showing the bolt in locking position.

FIGS. 1, 2, 3, 7 and 8 illustrate the invention as installed in place over a window opening 17 and locked in fully assembled relation so as to guard said window opening against illegal entry. At this time the bolt 60 is positioned as shown in FIGS. 7 and 8 after the two right end portions 34 and 35 of cross bars 30 and 31 have been lifted upward into the open bottom ends of hoods 50 and 51 so as to rigidly align and unite said right end portions 34 and 35 to the left end portions 32 and 33 of said cross bars. When the cross bars 30 and 31 of the grating 25 are thus rigidly assembled and held in this condition by the bolt 60, the handle 68 on the inner end of the wire cable 61 is drawn upwardly against the lower end of the cable housing 65 so as to be snugly held in place under the lug 67 while at the same time being free to move downwardly when pressure is applied to this handle manually and which of course is only intentionally done, as in an emergency when it is desired to release the window guard 15 from covering relation with the window opening 17 to permit people in the building to escape from a fire, or to facilitate cleaning windows.

Withdrawal of the bolt 60 from the locking position in which this is shown in FIGS. 7 and 8 to its unlocking position as shown in FIGS. 9 and 10 immediately releases the right end portions 34 and 35 of the grating cross bars 30 and 31 from support by the left end portions 32 and 33 of said cross bars. As the vertical pins 36 and 37 welded to the right end portions 34 and 35 of cross bars 30 and 31 have freedom to move in slots 24 provided in the hinge boxes 23, the pulling on handle 68 and the rightward shifting of bolt 60 as illustrated in FIG. 9 immediately causes the downward gravitation of the right portion of the grating 25 from the left portion thereof with a resulting positioning of these two portions in offset relation to each other as shown in FIG. 5, thereby permitting immediate outward swinging of the right hand portion of the grating through the full line position of this shown in FIG. 6 to the dotted line position shown in this view which completely removes the grating 25 from barring escape through the window opening 17 of any of the persons within the building 16, such as would be necessitated by a fire occurring in said building.

The function of the stop plugs 53 and 54 are clearly shown in FIGS. 7, 8, 9 and 10 as being to limit endwise movement of the bolt 60 in the operation of the device. The reason for providing the slot 55 in the bottom wall of right end portion 35 of the lower cross bar 31 is the need for having access to the space at the right hand end of the bolt 60 for relocking the grating 25 in assembled relation after it has been unlocked to permit occupants of building 16 to escape through the window opening 17. The slot 55 is of just sufficient width to permit the entry of a thin instrument such as the blade of a knife into engagement with the right hand end of the bolt 60 while the latter is positioned as shown in FIG. 10 and after the right hand portions of the grating 25 has been lifted to bring the right and left portions of the cross bars 30 and 31 into alignment as shown in FIG. 9 at which point pressure against the right hand end of the bolt 60 will force this into the left end portion of lower cross bar 31 as shown in FIG. 8 until it is stopped by stop lug 53. This movement of the bolt 60 will also pull the wire cable 61 into the grating 25 so as to raise the handle 68 from the broken line position in which this is shown in FIG. 4 to the full line position of this handle shown in said view.

While not essential to the invention, it has been disclosed in the drawing as including an X-shaped scroll 69 made of quarter inch by half inch steel bars bent as shown and welded to vertical bars 40, 45 and 46. The scroll 69 is at once ornamental and constitutes a bracing of the grating 25 which warrants its inclusion in the design.

It is to be noted that the seven vertical bars of the grating 25 are distributed across this so as to assign vertical bar 38 to the narrow left portion of said grating thereby giving substantial reinforcement structurally to said narrow grating portion while it is separated from the wider right portion of the grating.

The handle 68 is positioned close to the floor 70 and thus relatively remote from window opening 17 to prevent access being had to said handle from outside the building 16.

I claim:

1. In combination:

a grating means divided by joint means in a vertical plane into separate but interlockable sections;

means for mounting said grating means on a wall of a building so as to overlie an opening provided in said wall for a window, by separately securing said grating sections to said wall on opposite sides of said window opening;

hidden locking means operating on said joint means for assembling said sections of said grating means as a rigid unit protectively covering said window opening and preventing illegal entry of said building through said opening; and cable means connected to said locking means and hidden from access through said grating means from outside said building and terminating at a remote point within said building and functioning when pulled from within said building to unlock joint means and cause said grating means to separate at said joint means and yield readily from its normal position covering said opening and thus readily permit escape through said window in the event of fire.

2. A combination as recited in claim 1 wherein said grating means comprises a multiplicity of vertical steel bars welded at their upper and lower ends respectively to upper and lower horizontal hollow cross bars, end portions of which cross bars are bent rearwardly and are provided with brackets for securing the same to said building just outwardly from the four corners of said window opening, the left ends of said cross bars being welded to their brackets so as to be rigidly connected to said building, the right ends of said cross bars being connected to their brackets by loose hinge means permitting rotation about a vertical axis and substantially free for a degree of slippage horizontally;

said joint means being formed at corresponding points in said cross bars close to the left ends thereof at which said cross bars are divided so as to divide said grating into a relatively narrow left hand section and a relatively wide right hand section, said joint means including a pair of downwardly facing hoods welded to the relatively short left hand portions of said cross bars and into which the extremities of the right hand portions of said cross bars are adapted to be shifted upwardly to cause said joint means to form rigid connections between the divided portions of said cross bars; and wherein said locking means comprises bolt means slidable in one of said cross bars when said joint means are held in assembled relation to lock said joint means to hold said grating thus assembled and prevent unauthorized operation of said bolt means to unlock said joint means; and wherein said cable means connects to said bolt means and extends through the cross bar occupied by said bolt means and extends through the wall of said building so as to be concealed from view from outside said building; and housing means for concealing and guiding said cable means inside said building to a point remote from said window opening thus preventing unauthorized manipulation of said cable by a person reaching between the bars of said grating and through said window when the same is opened, or when the glass of said window is broken.

3. A combination as recited in claim 2 wherein one of said vertical steel bars is welded at its upper and lower ends to the left end portions of said cross bars so as to rigidly unite said left end cross bar portions when the latter are disconnected from said right end portions of said cross bars, the balance of said vertical steel bars being welded at their upper and lower ends respectively to the right end portions of said cross bars.

4. A combination as recited in claim 2 wherein said bolt means is mounted in the lower of said cross bars and said cable means occupies and is concealed by the right hand portion of said lower cross bar; and wherein said housing means for concealing and guiding said cable means inside said building receives said cable means at a level just below said window opening and extends downwardly to a point near the floor of said building; and wherein said cable means includes a handle which is drawn upwardly against the lower end of said housing means when said bolt means is slid into locking relation with said grating.

5. A combination as recited in claim 4 wherein stop means are provided in said lower cross bar on opposite sides of the dividing joint means to set the limits of movement of said bolt means between a locking position thereof and a unlocking position thereof; and wherein slot means is provided in the right hand portion of said lower horizontal hollow cross bar, said slot means being located behind said bolt means when the latter is in unlocking position and affords access of a thin instrument to the interior of said right end portion of said lower horizontal hollow cross bar for applying pressure to said bolt means to slide the latter from unlocking position to locking position when said right end portion of said grating is lifted upwardly into alignment and interlocking relation with the left portion of said grating.

6. In combination:

a grating means including upper and lower horizontal cross bars, one of which is hollow, and a series of connecting bars welded at their ends to said horizontal bars;

means forming slip joints in said cross bars near one side of said grating optionally permitting vertical separation of a major end section of said grating means from a minor end section thereof or the vertical interlocking of said sections with each other;

means for mounting said grating means on a wall of a building so as to overlie an opening provided in said wall for a window and securing said minor grating section rigidly to said wall at one side of said opening and securing said major grating section articulately to said wall at the opposite side of said opening thereby permitting said major grating section to gravitate out of interlocking relation with said minor grating section and swing open about its articulate connection with said wall;

locking means concealed within said hollow cross bar for optionally uniting said slip joints with said grating sections in interlocking relation to rigidly unify said grating means; and flexible means concealed within said hollow cross bar and penetrating said building wall to be optionally operated from a remote position within said building in an emergency to disconnect said grating sections, freeing said major grating section to swing outwardly permitting ready engress from said building through said window opening.

7. A combination as recited in claim 6 wherein said locking means includes a slide bolt which occupies abutting end portions of said hollow cross bar when uniting said major and minor grating sections.

8. A combination as recited in claim 7 wherein a slot is provided in the major portion of said hollow cross bar for the introduction of a thin instrument to reset said slide bolt in locking position.

* * * * *